United States Patent [19]

Mentz

[11] 4,107,023

[45] Aug. 15, 1978

[54] FILTER PRESS HALATE CELL

[75] Inventor: Bernardus J. Mentz, Pitt Meadows, Canada

[73] Assignee: Hooker Chemicals & Plastics Corporation, Niagara Falls, N.Y.

[21] Appl. No.: 703,721

[22] Filed: Jul. 9, 1976

[51] Int. Cl.[2] ..... C25B 1/14; C25B 1/26; C25B 9/00; C25B 9/02

[52] U.S. Cl. ..... 204/269; 204/267; 204/279; 204/286; 204/270

[58] Field of Search ..... 204/253-299, 204/267, 268, 269, 270, 286, 98, 128

[56] References Cited

U.S. PATENT DOCUMENTS

| | | | |
|---|---|---|---|
| 2,891,900 | 6/1959 | Kollsman | 204/301 |
| 3,287,251 | 11/1966 | Horne et al. | 204/270 |
| 3,489,614 | 1/1970 | Tomter | 136/86 |
| 3,778,362 | 12/1973 | Wiechers et al. | 204/268 X |
| 3,836,448 | 9/1974 | Bouy et al. | 204/270 |
| 3,864,236 | 2/1975 | Lindstrom | 204/265 |

*Primary Examiner*—Arthur C. Prescott

*Attorney, Agent, or Firm*—Peter F. Casella; Howard M. Ellis

[57] ABSTRACT

A filter press halate cell is disclosed, where a plurality of electrode units are arranged to form a cell. Each unit comprises a synthetic organic polymeric electrolytic cell frame housing an anode and a cathode in spaced relationship with each other. The cell frame contains electrolyte, initially a metal halide solution, and is arranged to allow electrical current to be conducted through the solution and between the anode and cathode, partially electrolyzing the solution to halogen, metal hydroxide and hydrogen. The halogen and metal hydroxide react at least partially in the cell to form hypohalite, halide and water. Means are taught for introducing feed through an inlet, and withdrawing electrolyte through an outlet. Clearance means and passageway means are taught for conducting reaction products upwardly between the anode and cathode and through the cell, as are means for removing hydrogen at the top of the cell. A plurality of molded-in baffles conduct hypochlorite solution downwardly through the cell, while retaining it long enough to convert it to halate.

20 Claims, 12 Drawing Figures

FILTER PRESS HALATE CELL

BACKGROUND OF THE INVENTION

This invention relates to an apparatus for the manufacture of alkali metal halates. More particularly, it relates to a cell frame of the filter press design having means for positioning and holding anodes and cathodes in spaced relationship. Internal titanium intercell connectors hold the anodes to a molded synthetic organic polymeric electrolytic cell frame reinforced with such reinforcement materials as mica, asbestos fiber, calcium silicate or other suitable materials.

Alkali metal halates, e.g., sodium chlorate, can be prepared by electrolysis from alkali metal halide, usually purified to free it from heavy metals and from magnesium and calcium compounds. The formation of sodium chlorate by electrolysis of a sodium chloride brine solution represents a complex series of electrochemical and chemical reactions. The cell liquor product of electrolysis is concentrated, after which separation of sodium chloride and sodium chlorate takes place in a crystallizer. Final separation can be obtained in a batch centrifuge, and drying may be carried out in a heated air rotary drier, for example, after which the material can undergo grinding, screening, and packing operations.

The maintenance of a high operating efficiency depends upon a number of factors including temperature, pH, addition agents, and other factors. Chlorate cells generally have been constructed of iron tanks which are often completely lined with concrete. Such a steel-reinforced concrete chlorate cell is described in U.S. Pat. No. 3,401,109 to Anderson. Cell anodes are typically constructed of graphite or valve metals, and are immersed completely within the enclosing tank. Illustrative of such designs are U.S. Pat. No. 3,553,088 to Grotheer et al. and U.S. Pat. No. 3,676,315 to Goens et al. It is necessary to line the inside of such cells with a polymeric material or other nonconductive plasticized resin liner, such as polyvinyl chloride resin, polyvinylene chloride resin, polypropylene, or others. Such liners are described in U.S. Pat. No. 3,403,901 to Currey et al.

A difficulty commonly encountered with such lined concrete cell containers is their susceptibility to chemical attack in the corrosive environment of liquid and gaseous components typically present within a chlorate cell. Illustrative of corrosive materials present in the chlorate cell are concentrated brine (about 100–140 grams per liter); concentrated sodium chlorate solution (about 400–500 grams per liter); sodium hypochlorite solution (2–3 grams per liter); and gas with a chlorine content of about 0.5–3% chlorine, and an oxygen content of about 3%, all at a temperature of about 70° C.

In addition, such tank-type chlorate cell structures are bulky and heavy, and require a substantial capital investment for fabrication and construction. Such tank-type cells have a fixed capacity, and lack any convenient means for adding to or reducing their operational capacity.

SUMMARY OF THE INVENTION

The present invention eliminates the enclosing tank of conventional chlorate cell design. Electrode units may be easily added or removed to provide a cell comprising a plurality of individual electrode units comprising from 1 to as many as 100 or more anode and cathode pairs, preferably from about 20 to about 50 pairs. Such pairs are separated by a spacer, which can be constructed of a material which is impervious and chemically resistant to the electrolyte, thereby avoiding problems of chemical attack of cell walls. It is possible to remove one electrode unit from the cell arrangement of the present invention in order to perform maintenance or repair work, reassemble remaining cell units, and keep the remainder of electrode units in operation. This can improve production efficiency by allowing routine maintenance to be carried out without a complete shutdown of an entire electrolytic cell, as is required with a tank-type cell arrangement.

With the advent of dimensionally stable anodes it has now become possible to increase the productivity of chlorate cell assemblies. With the use of flat electrodes and a thin molded reinforced frame made of polypropylene or other reinforced material separating the electrodes, it has become feasible to manufacture thin cell assemblies, leading to uniformity of electrode separation and lower internal cell resistances. As used herein, the term "polypropylene" is inclusive of propylene homopolymers, propylene copolymers, mixtures thereof, and the foregoing optionally mixed with filler materials impact modifiers, and reinforcing agents. Efforts to discover satisfactory materials which can be made into satisfactory chlorate cells which are thin, readily manufactured and capable of withstanding chlorate cell conditions of temperature, reactants and products have led to a reinforced polypropylene frame, reinforced with materials such as either mica or asbestos fiber. Machining of filled polymers has proved often undesirable for long term electrolytic applications, such as cell frames, especially for use in the presence of electrolyte and cell products at elevated temperatures, or when the temperature varies over a range sufficiently wide to cause expansions and contractions which can develop weaknesses in the filled polymer surface where the filler is exposed. In addition, machined cell frames have often been expensive and the product made has not been resistant to electrolytic conditions, possibly because of strains developed in the plastic during machining or because of incipient weaknesses created thereby. The molded frames of the present type are, however, comparatively simple to make, assemble and use and are of long life, being highly resistant to checking, warping, expanding, contracting, creeping and other distortions during the electrolysis of aqueous sodium chloride solutions. Recesses are molded into the polypropylene frame to allow for proper positioning of the anodes, which are removable by removing titanium bolts or screws from internal titanium intercell connectors. The same means is employed to position each steel cathode, except that a rubber gasket seal isolates the reverse side of the cathode from the cell liquor. In preferred embodiments of the invention the synthetic organic polymer frame for housing the anode and cathode is polypropylene containing a filler or reinforcing fiber such as asbestos, mica, calcium silicate, talc, or mixtures thereof. The frame is injection molded, and includes integral external alignment and fastening means for holding a plurality of frames together in a cell assembly. Contemplated within the invention are methods of electrolyzing, utilizing electrolytic cells incorporating the present frames, and intermediate mounting means or frames for electrodes for holding them in desired positions in the present frames. Sealing between the steel cathode and polypropylene frame support structure is effected by compressive force applied by flat head screws along the top and bottom edges of the electrode.

Sealing along the remaining two sides along the electrode is achieved by the external compressive force applied during filter press construction. Channels are molded behind the cathode to allow coolant to circulate, and baffles are molded behind the anode to provide anode support, strengthen the web and hold the hypochlorite reactant during its conversion to chlorate. Means for withdrawing chloride-containing liquor and means for feeding sodium chloride to the cell may be built into the polypropylene frame. Means may be provided for withdrawing gaseous material from the cell and for conducting gaseous products into and along a collection header.

A plurality of electrode units are ordinarily fitted together to effect a series cell arrangement, each electrode unit comprising a steel cathode, polypropylene frame and titanium anode. To insure a uniform anode-cathode spacing, a plurality of Teflon cords are arranged vertically in the gap, which contains electrolyte, between adjacent electrode units. Special internal intercell connectors are used to improve electrical conductivity within the electrode unit. Two connectors per electrode unit, each comprising a cast titanium piece having welded to it a section of titanium clad copper or brass rod is machined to remove the cladding and threaded to make up the cathode connection. Electrical current is introduced into the series cell arrangement through connections to the end electrode units. Compressive force sufficient to maintain leak-free seals along all elements around the cell frame is applied by a hydraulic ram or screw jacks. A clamp or other holding device can then be used to maintain the proper compressive force.

In this description of illustrative embodiments of an alkali metal halate electrolytic cell, reference will be made to the production of sodium chlorate from an aqueous solution of sodium chloride, although it is clear that this is for the purpose of simplicity of description, since it is possible to make other alkali metal halates, e.g., sodium bromate or potassium iodate, by the methods and apparatus herein described. It is furthermore to be kept in mind that various equivalent structures may be substituted for those mentioned and replacements may be made which are apparent to one skilled in the art to which this invention pertains.

DETAILED DESCRIPTION OF THE DRAWINGS

Figure 1:
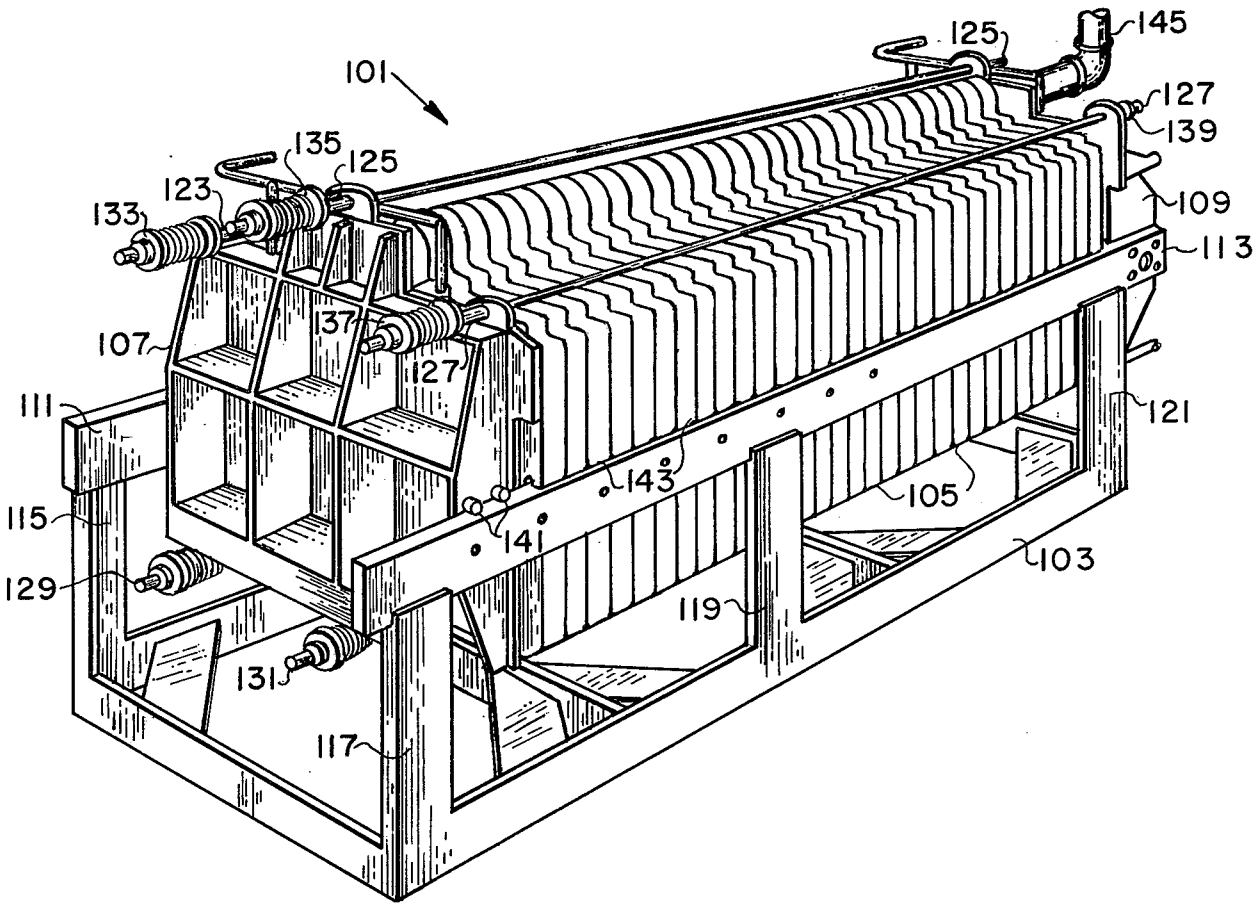
FIG. 1 is a perspective view of a cell assembly incorporating a plurality of frames of this invention.

In FIG. 1 electrolytic cell assembly 101 comprises a base 103, individual cell frames 105 mounted together with gaskets (not shown) between them for sealing purposes, compression front end plate member 107, compression rear end plate member 109, horizontal side supporting bars 111 and 113, held to base 103 and supported above it by vertical members 115, 117, 119, and 121, and rods 123, 125, 127, 129, and 131, each of which is threaded at both ends thereof and each of which has tightening nuts such as 133, 135, 137, and 139 thereon for pressing the end plates together and thereby holding the frames together in fluid-tight relationship. Pins 141 facilitate sliding movement of plate member 107. Plate members 107 and 109 contain or have connected to them pieces with passages for holding the tightening rods 123, 125, 127, 129, and 131 in position and for transmitting tightening forces to plate members 107 and 109. Cell frames 105, the structures of which will be further illustrated in FIGS. 2, 3, 4, and 5, contain external alignment means 143, which comprises external members integral with the frames and molded to fit or rest on supporting bars 111 and 113 to facilitate assembly. Gas take-off line 145 is shown held to cell assembly 101 by means of plate member 109 and is in communication with the gas discharge header composed of molded-in portions of the contiguous cell frame 105, which will be described later, in conjunction with FIGS. 2, 3, 4, and 5.

Figure 2:
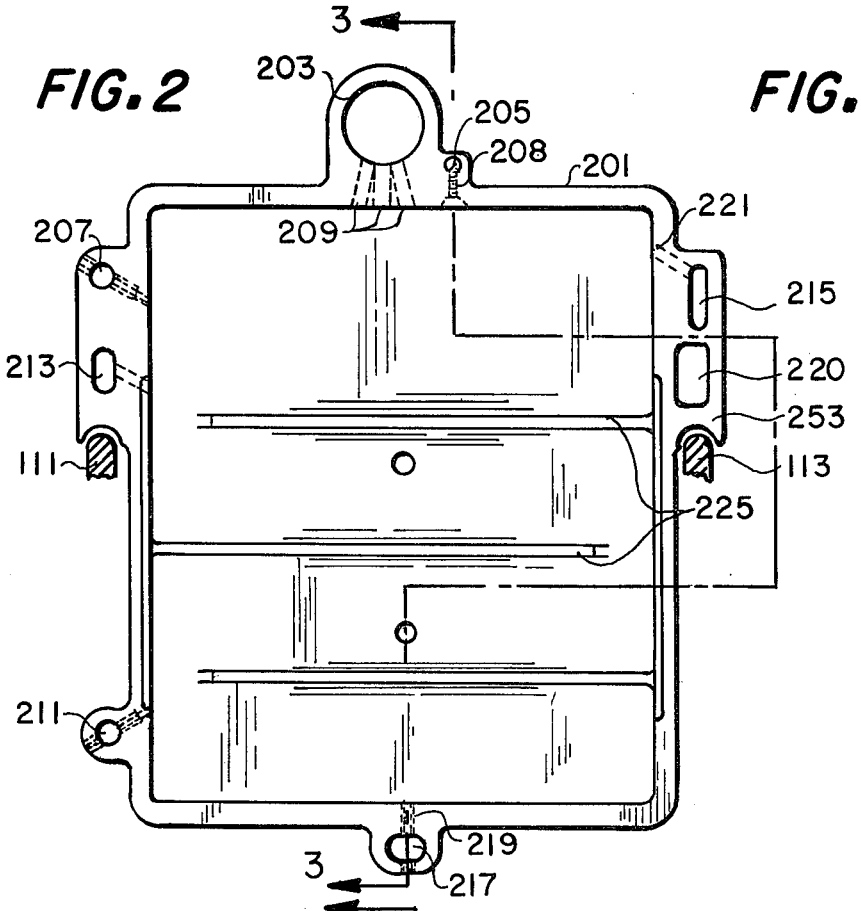
FIG. 2 is a sectional elevational view of the anode side of an intermediate frame.

In FIG. 2, cell frame 201 resting on supporting bars 111 and 113 includes a gas outlet manifold 203, a nitrogen purge channel 205, purge gas passage 208, feed header orifice 207 to control feed liquid flow, gas outlets 209 to gas outlet manifold 203, coolant inlet orifice 211, coolant collection header 213, electrolyte overflow header 215, drain header 217, and drain passageway 219. A plug (not shown) prevents fluid leakage from orifice 207, and another plug (not shown) from orifice 211, to the exterior of cell frame 201. Gripping means 220 facilitate handling cell frames 201 during disassembly of the cell. Plug 218 can be removed during cell shutdown to facilitate removal of any obstructions which become during cell operation bridged in drain passageway 219. It will be noted that overflow passageway 221 carries the electrolyte effluent to header 215 from the electrolyte identified as 223 in FIG. 3. Baffles 225 are molded into cell frame 201 and are located behind the anode assembly, illustrated in FIGS. 6, 7, and 8.

Although not specifically illustrated, it is contemplated within the present invention to employ, "tortuous passage" feed and outlet streams so as to increase the resistance of any stream through which current leakage might occur. Thus, with respect to feeds of liquids through orifices, because of the smaller streams, the resistances thereof will be greater and current leakages will be diminished. This will be especially effective with respect to the upper feed locations when orifices are employed which are small enough to produce droplets of feed liquids which are discontinuous as they fall through the gas phase above the electrolyte. Such discontinuous streams provide very high resistance against current leakage. Similarly, such interrupted streams may be produced where the overflow is withdrawn, with the cell liquor and depleted anolyte dropping to lower levels, in which dropping discontinuous "streams" are created.

Figure 3:
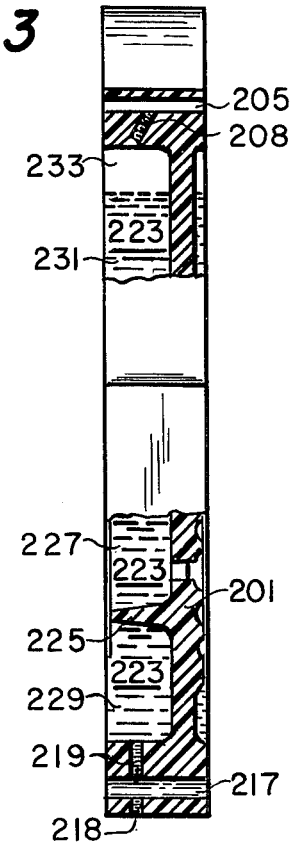
FIG. 3 is a partially cut-away vertical sectional view along plane 3—3 of FIG. 2.

In FIG. 3 is shown cell frame 201 cut away to show the electrolyte 223, drain header 217 with connecting drain passageway 219, plug and connecting purge gas passageway 208 to nitrogen purge channel 205. Also shown are electrolysis chambers 227 and 229, electrode head chamber 231 and head space 233.

Figure 4:
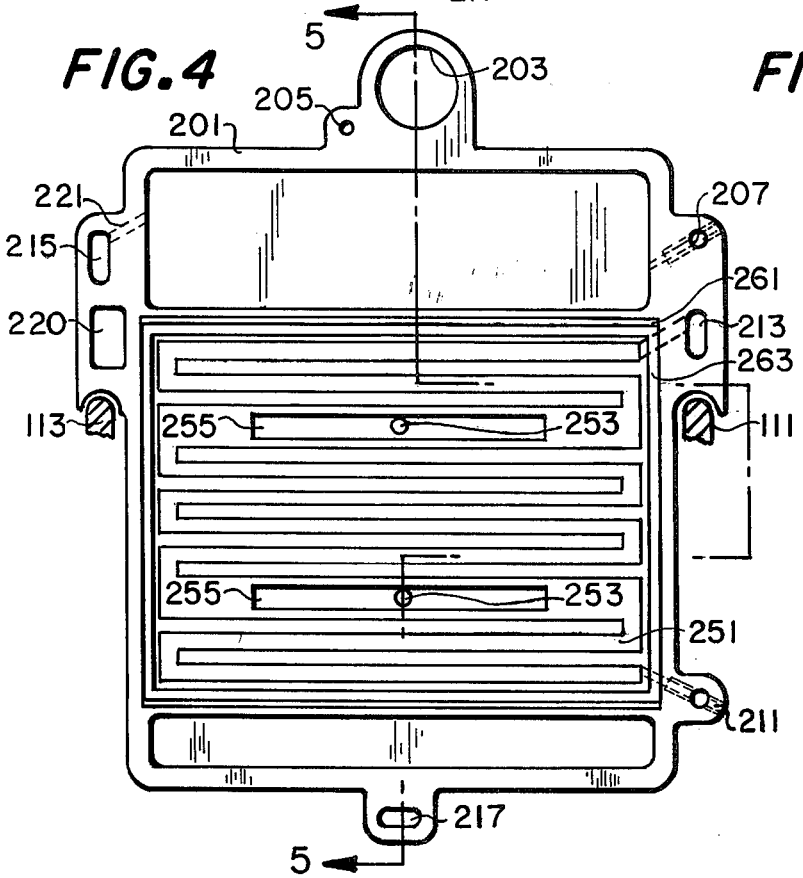
FIG. 4 is a sectional elevational view of the cathode side of an intermediate frame.

FIG. 4 shows the cathode side of the same intermediate frame as is shown from the reverse (i.e., anode) side in FIG. 2. Cell frame 201 includes the gas outlet manifold 203, nitrogen purge channel 205, feed header orifice 207, coolant orifice 211, coolant collection header 213, electrolyte overflow header 215, drain header 217, and gripping means 220. A plug (not shown) prevents fluid leakage from orifice 207, and another plug (not shown) from orifice 211, to the exterior of cell frame 201. Overflow passageway 221 carries electrolyte effluent to header 215 from electrolyte 223. When assembled, the cell frame rests upon supporting bars 113 and 111. Coolant channels 251 are cut into cell frame 201 to provide cooling behind the cathode. Groove 263, located around the periphery of the catholyte chamber, is provided to hold the cathode sealing gasket in recess 263 (shown on FIG. 11), and ledge 261 provides a surface for the edge of cathode 403 (see FIG. 9) to rest.

Figure 5:
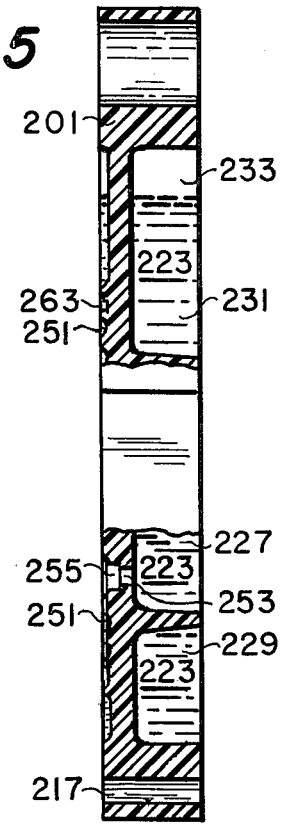
FIG. 5 is partially cut-away vertical sectional view along plane 5—5 of FIG. 4.

In FIG. 5 is shown cell frame 201 cut away to show the drain header 217, cathode coolant channels 251, cathode bolt receptacle 253 and electrolyte 223. The cathode assembly, illustrated in FIGS. 9 and 10, fits into slots 255. Also shown in FIG. 5 are electrolysis chambers 227 and 229, electrode head chamber 231 and head space 233.

Figure 6:
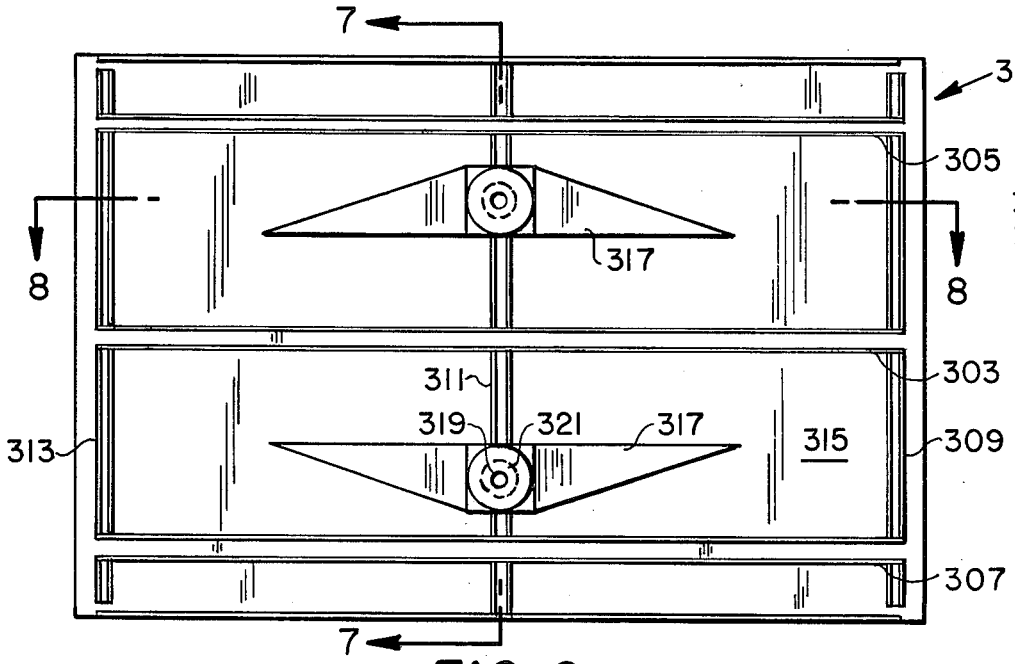
FIG. 6 is a sectional elevational view of an anode assembly.

FIG. 6 shows the anode assembly 301, wherein horizontal support channels 303, 305 and 307, and vertical support channels 309, 311 and 313 are spot welded at intervals along their length to anode 315. The interval of spot welding of channels 303, 305, 307, 309, 311 and 313 to anode 315 is preferably from ⅛ inch to 6 inches, more preferably ½ inch to 2 inches, and most preferably 1 inch. Current distributor 317, preferably made of titanium, assists in conducting electrical current through the bipolar cell assembly, as will be described further in discussion of FIG. 12. Current distributor 317 is welded on the surface of anode 315 visible in FIG. 6, that is, the surface of the anode assembly which faces the anode side of cell frame 201, as shown in FIG. 2. A bolt (not shown in FIG. 6) passes through anode bolt hole 319 and is tightened from the back side of FIG. 6 in the hidden anode bolt head tightening space 321 during assembly of a bipolar frame unit in the manner which will be disclosed in discussion of FIG. 12.

Figure 7:
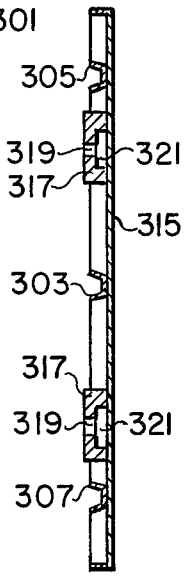
FIG. 7 is a vertical sectional view of an anode assembly along plane 7—7 of FIG. 6.

FIG. 7, showing anode assembly 301 through section 7—7 of FIG. 6, shows anode 315 with channels 303, 305 and 307, current distributors 317, anode bolt holes 319, and anode bolt head tightening spaces 321.

Figure 8:
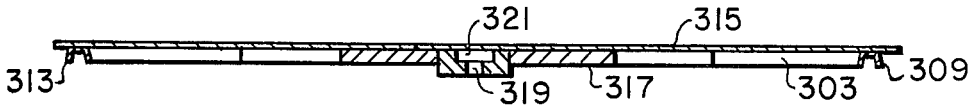
FIG. 8 is a horizontal sectional view of an anode assembly along plane 8—8 of FIG. 6.

FIG. 8 shows anode assembly 301 through section 8—8 of FIG. 6. Channels 313 and 309 are spot welded to anode 315, and current distributor 317 is welded to anode 315, with anode bolt hole 319 and anode bolt head tightening space 321 also shown.

Figure 9:
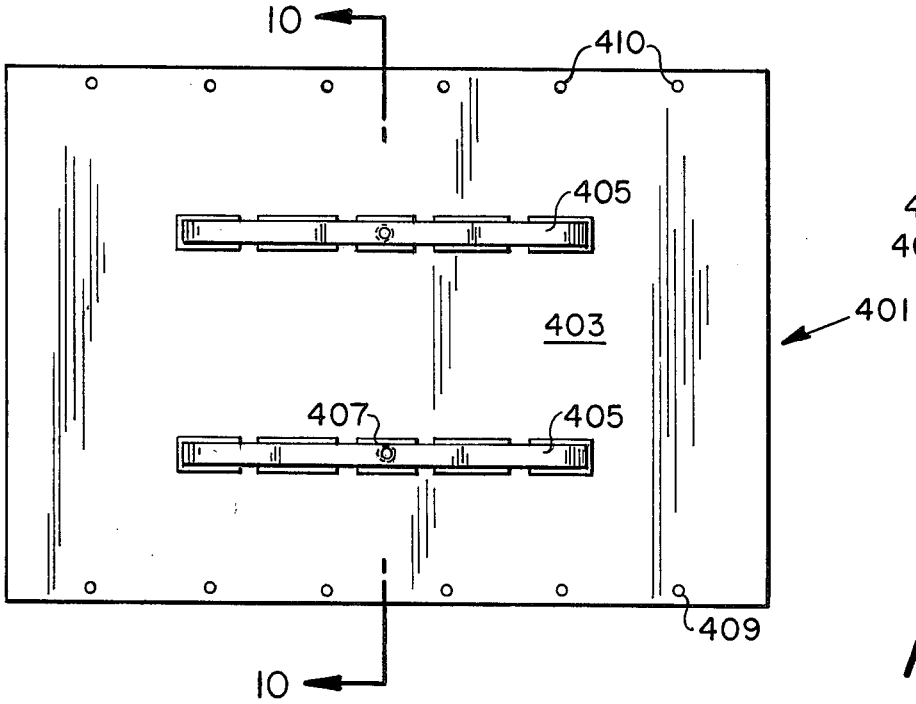
FIG. 9 is a sectional elevational view of a cathode assembly.

FIG. 9 shows cathode assembly 401, wherein busbar current distributor 405 is welded to cathode 403. Cathode bolt hole 407 passes through busbar current distributor 405, but does not pass into or through cathode 403. Holes 410 along the top edge and holes 409 along the bottom edge of cathode 403 promote circulation of electrolyte, such holes 409 and 410 being preferably positioned over the respective portions of circumferential groove 263 in cell frame 201 (see FIG. 4) after assembly of the cell. In assembling a bipolar unit, cathode assembly 401 faces the cathode side of cell frame 201 (see FIGS. 2 and 4) with busbar current distributors 405 fitting into slot 255 of the cell frame depicted in FIG. 4.

Figure 10:
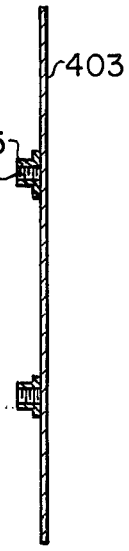
FIG. 10 is a vertical sectional view of a cathode assembly along plane 10—10 of FIG. 9.

FIG. 10, a section of the cathode assembly 401 along section 10—10, shows busbar current distributors 405 welded to cathode 403, and containing threaded cathode bolt hole 407.

Figure 11:
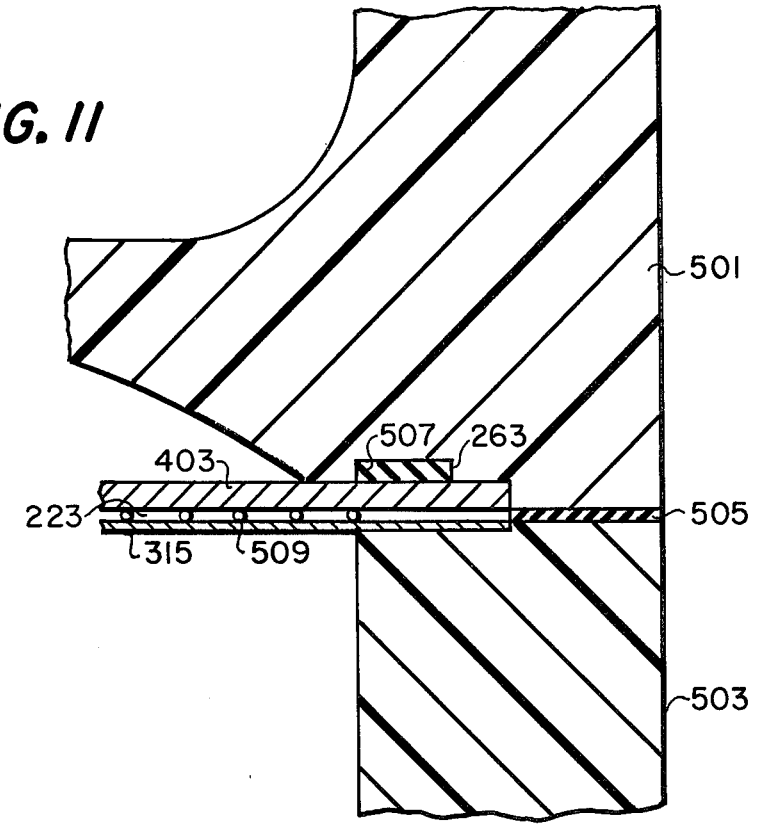
FIG. 11 is a partial sectional view showing sealing surfaces between frames.

FIG. 11 shows the sealing means between adjacent cell frames 501 and 503, which when assembled according to the cell arrangement of FIG. 1, will be under compressive force. Slot gasket 505 forms a sealing surface against each cell frame 501 and 503, and comprises an elastomeric sealing substance, such as neoprene, viton, rubber, or other suitable material, preferably neoprene. Within sealing recess 263, identical with the groove 263 shown on FIGS. 4 and 5, flat sealing gasket 507 seals cathode 403 against cell frame 501 to prevent seepage of electrolyte 223 along the cathode-cell frame interface. Recess 263 can also be located so as to allow cathode sealing gasket 507 to be in sealing contact with cell frames 501 and 503. Spacer cords 509 pass through electrolyte 223 to maintain a uniform spacing between cathode 403 and anode 315. Spacer cords 509 can be made of an electrolyte-resistant material, preferably polytetrafluoroethylene (Teflon®). Cathode 403 and anode 315 are maintained at a different electrical potential during operation of the cell. Spacer cords 509 are preferably tied to anode 315.

Figure 12:
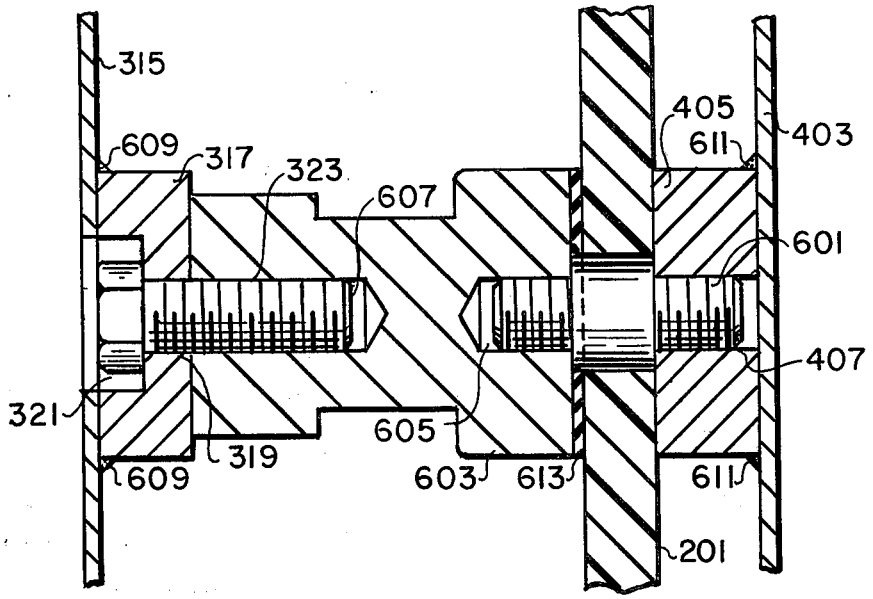
FIG. 12 is a sectional view of an intercell connector.

FIG. 12, illustrating an intercell connector means, shows a solid metallic intercell connector 603 and threaded stud 601, which is welded into drilled recess 605. Intercell connector 603 is constructed of an electrolyte-resistant material, preferably titanium, which is drilled and threaded from one end to create threaded recess 607. Current distributor 317 is welded to anode 315 at anode weld 609, and is drilled to form anode bolt hole 319. Current distributor 317 and anode 315 are drilled to create anode bolt head tightening space 321. During assembly, anode bolt 323 is tightened to bring current distributor 317 into secure electrical contact with intercell connector 603. Busbar current distributor 405 is welded to cathode 403 at cathode weld 611. Cathode bolt hole 407 is contained in busbar current distributor 405, and during assembly, tightening threaded stud 601 brings intercell connector 603 into secure electrical contact with busbar current distributor 405. In such tightening, cell frame 201 is sealed against intercell connector 603 by means of sealing gasket 613, which may be of a suitable elastomeric substance resistant to the cell environment, preferably neoprene, and which prevents leakage of electrolyte into the cell frame 201 interior. In assembling the bipolar unit of FIG. 12, the cathode assembly, cell frame and intercell connector are first joined, following by the bolting of the anode assembly to the intercell connector. It should be further noted that spacer cords separate each bipolar unit from the adjacent unit, and are not illustrated in FIG. 12.

In modifications of the structure illustrated, a monopolar type of cell is readily produced by merely changing the electrical connectors so that each cell is independently charged with an electrolyzing voltage.

Similarly, electrical connections between bipolar cells may be made internally, rather than externally of the cell. Instead of having the electrical connections at the top of the cell they may be at the side thereof. Instead of using the neoprene gaskets, which are squeezed tightly against the electrode conductors by compression, other forms of seals may be employed, including single O-rings, cylinders, hollow cone wedges, etc. Such materials may be of neoprene or other suitable polymers, e.g., polytetrafluoroethylene or other fluorinated polymers. Instead of using positively held means for fastening the electrodes in place, such means may be elastic, such as neoprene bands, pressing the gasket or other parts against the frame during assembly, possibly fitting into hollows in the frame. Such temporary means can be employed until the various frames are tightly pressed together during construction of the cell assembly. Alternatively, instead of employing such means, a cement, such as a neoprene cement, which holds the gaskets, electrodes and frames in place temporarily, can be used. Such cement should be sufficiently strong to hold the various parts together in correct relationship until "permanently" fastened by pressing together of the various frames. Upon disassembly the cement would not so tightly bind the various parts as to cause permanent damage upon removal. In some cases, it may be possible to dispense with the use of gaskets and employ mating parts of the polypropylene frames which are so tightly held together by the assembly compressing means as to maintain the various interposed parts in desired "permanent" relationship without the need for softer gasketing materials to prevent leakages. Where one dispenses with the neoprene gaskets the resilience of the polypropylene frame may be increased by including rubber or other elastomeric materials in the molding compositions, e.g., 5 to 25% of ethylene propylene elastomer. The cell frames illustrated in FIGS. 2 and 4 are those of a central portion of the cell assembly. It is evident that the terminal frames are of a different design, being essentially half cell frames with the exterior sides blanked off. It is not thought to be necessary to illustrate such structures here because they are considered to be self-evident.

The material of construction of the present cell frames which has been found to be most satisfactory in use and can be injection molded readily is polypropylene, more particularly, polypropylene filled with a suitable "filler" such as one selected from the group consisting of asbestos, mica, calcium silicate, talc and mixtures thereof. The mixtures of fillers mentioned may be of two, three of four components but it is considered especially beneficial to include both the calcium silicate and mica in such mixtures. In some cases, art-recognized equivalent fillers may also be used. If only one of the fillers is to be employed it is preferred that it be calcium silicate, of which the fibrous form is considered to be best. The polypropylene to which reference is made may be a normal resin intended for injection molding, and can be selected from the categories of unmodified, copolymer, inert filled or impact (rubber modified) polypropylenes as given in 1973–1974 *Modern Plastics Encyclopedia,* at page 552, with the properties summerized therein. Thus, such resins, when injection molded according to the methods described at pages 338–410 of that publication, incorporated herein by reference, produce useful electrolytic cell frames suitable for employment in "filter press" assemblies of preferably from about 10 to about 60 of such frames, for the electrolysis of aqueous sodium chloride solutions.

Another cell frame construction material which can be used is a phenylene oxide-based resin, possessing high heat resistance, dimensional stability, and impact strength at temperature extremes, as described in 1975–76 *Modern Plastics Encyclopedia,* at page 46. Such materials can include a "filler" of the type and in the proportions hereinafter disclosed and described.

The frames described resist the electrolyte and products of electrolysis and are satisfactorily dimensionally stable during electrolysis, even over temperature variations from about 40° to 95° C. and pH variations from about 3 to 14. Although it is possible to utilize polypropylene resin containing no copolymer and no rubber, provided that the desired content of "filler" sufficiently improves the dimensional stability, heat resistance, and other properties, to make the material satisfactorily operative in commercial chlorate cells, usually one will employ a mixture of homopolymer and copolymer. In such mixtures the proportion of each component will normally be from about 10% to 40% of copolymer, such as that sold by Shell Chemical Company as Shell 7525, and about 10% to 40% of homopolymer, with the total content of such components being about 40% to 90% of the final product. Instead of the homopolymer, copolymers of propylene with other comonomers may be utilized, e.g. propylene-acrylic acid copolymers, such as Exxon D-561. The proportion of rubber impact modifier may be from 0 to about 20% but it is preferably present and will normally be from about 3% to about 15% of the product. When the term "polypropylene" is used herein in a general sense it is inclusive of propylene homopolymers, propylene copolymers, and mixtures thereof. Suitable comonomers can include unsaturated lower organic acids, e.g., acrylic acid, methacrylic acid and other monoalkenoic acids of 3 to 6 carbon atoms and equivalents.

The "filler", while it may be talc, asbestos, calcium silicate or mica or a mixture thereof, preferably includes calcium silicate fibers, such as wollastonite fibers or synthetic calcium silicate fibers and may preferably include, additionally, mica flakes or platelets. The calcium silicate, either natural or synthetic, asbestos and talc fibers may be of a variety of diameters commercially available, from about 180 Angstroms for chrysotile asbestos to as much as one millimeter, although usually the diameters will be less than 0.1 mm., e.g., about 0.001 to 0.05 mm. Fiber lengths will normally be in the range of about 10 to one million times the diameter, preferably 20 to 1,000 times, and will normally be in the range of about 1 mm. to 2 cm. Similarly, the mica employed will usually be finely enough divided to pass through a 140 mesh screen, preferably through a 200 mesh screen, (United States Standard Sieve Series). Although these sizes are mentioned as guides, it will be evident that in some cases it may be desirable to utilize different sizes of materials for special effects.

The proportion of the described inorganic filler material in the present injection molded frames is from about 10% to 60%, preferably about 15% to 50% and more preferably about 20% to 40%, most preferably about 23%. Preferably from about 50% to 100% of the filler material is calcium silicate fiber. However, in some embodiments of the invention, from 10% to 30% of asbestos will be employed with about 90% to 70% of polypropylene homopolymer, or about 5% to 20% of mica flake, about 10% to 30% asbestos fiber, about 15% to 50% of polypropylene homopolymer and about 20% to 60% of polypropylene copolymer may be utilized and will produce satisfactory products. In place of a portion of the calcium silicate there may be substituted an equal proportion, from about 10% to 50% thereof, of talc powder. Also, the calcium silicate, the talc, or both, may be treated with silanes or silicones to modify the silanol and siloxane groups thereon and to vary properties of the molded polypropylene. Various rubber impact modifiers of known types may be employed for their obvious purpose. The rubbers utilized can be any of those normally acceptable for this purpose in the polymer art and mixtures of these can also be employed but elastomers based on polyethylene or polypropylene are preferred, as are those based on both such polymers.

Various other additives may be present in small proportions, usually to the extent of no more than about 10% and preferably no more than about 5% in the present molded products, e.g., colorants, mold release agents and fire retardant chemicals. Descriptions of such materials and of the polymers, fillers and rubbers employed in making the injection moldable polypropylene resin composition utilized in this invention are described in more detail in the 1973–1974 *Modern Plastics Encyclopedia* and in the 1972–1973 edition of this work and accordingly, are not described further herein.

The injection molding of the frames is in accordance with known procedures for molding large items (the frame size is preferably about 1.1 meter by about 1.1 meter by about 9 cm. and the distance between anode and cathode in the cell formed by fitting together of two frames is normally about 1 cm.). A description of such molding is found in the article entitled *Giant, Thick-Sectioned Plastic Parts Achieved by New Method,* appearing at page 42 of the May 1972 issue of *Product Engineering* and in the article entitled *Unusual Technique Makes 'Impossible' Parts,* at page 53 of the September, 1971, issue of *Modern Plastics.* Such molding techniques are such as those practiced by Eimco Envirotech. Details of suitable molding methods are given in the articles, which are hereby incorporated by reference.

The molded frame, although produced from thermoplastic materials, does not soften at the operating temperatures of the present electrolytic cells, which can go as high as about 95° C. The cells operate continuously for lengthy periods of time, e.g., six months, without warping, cracking, failing, sagging or otherwise showing objectionable evidence of lack of dimensional stability. Without the reinforcing inorganic filler materials results are not as satisfactory but the molded frames are still useful. It is considered that the molding operation, which tends to cover all fibrous material near the surfaces of the molded item, effectively prevents any exposure of such reinforcing material to the contents of the electrolytic cell, thereby aiding in stabilizing the injection molded frame. Thus, such products are considered to be superior to similar ones where a cell frame is machined from stock material of reinforced polypropylene.

Cell frames made of phenylene oxide-based resin can be reinforced with fillers such as calcium silicate, asbestos, or mica, in which case injection molding is the preferred molding technique. Unreinforced frames made of phenylene oxide-based resin can be vacuum molded, and such frames can be formed in two or more sections, and subsequently fused together by heat, ultrasonic vibration, or by other mechanisms.

The materials of construction of the various components of the present cell are chosen for resistance to the halate cell environment. The anode construction is comparatively easily manufactured, being primarily a valve metal, often in sheet form, and coated with a noble metal or noble metal oxide. Instead of solid sheet anodes, perforated metals, expanded metals and screens may also be employed. The anode is preferably of titanium, although other valve metals are also useful, for example, tantalum. Preferably, the anode is activated with ruthenium oxide on the surface away from the cell frame.

The cathode utilized may be of any electrically conductive material which resists the attack of cell liquor, preferably iron or an iron alloy such as steel or stainless steel. Suitable cathodes can be made of steel plate joined to a copper conductor, but other cathode materials and conductor materials can also be employed, among which are iron, graphite, lead dioxide on graphite, lead dioxide on titanium, and noble metals, such as platinum, iridium, ruthenium and rhodium. The noble metals can be deposited as coatings on conductive substrates, such as copper, silver, aluminum, steel and iron substrates. The cathodes used preferably will be of steel plate and will be flat or of other conforming shapes so that the inter-electrode distances will be approximately the same throughout. Both electrodes will normally be maintained in perfectly vertical or substantially vertical position, usually not being more than about 10° from the vertical and preferably not more than about 5° therefrom.

The stud is welded to the intercell connector and linking the intercell connector electrically with the busbar current distributor is preferably of a metal with a high specific conductivity, and also high chemical resistance to electrolyte solution, such as titanium-clad copper. The intercell connector is of a metal which is highly resistant to corrosion, such as noble metals or valve metals. Titanium is a preferred material for the intercell connector, although other materials such as tantalum or titanium-clad copper can be used.

To maintain the desired space in which electrolyte 223 is present between the surfaces of the anode (315 in FIGS. 6, 7, 8 and 11) and cathode (403 in FIGS. 9, 10 and 11), grooves (251 in FIGS. 4 and 5) are provided in the cathode and suitable synthetic organic polymeric spacer lines or cords (509 in FIG. 11), preferably of polytetrafluoroethylene, (Teflon®), are fitted in them and passed about the anode sub-assembly before assembly of the cell. The lines or cords may be tied, preferably at the top of the anode sub-assembly or may be fused together, crimped or otherwise suitably held. The spacer lines or cords can be tightly pulled together through a crimpable sleeve, which is then distorted to hold them in place, after which they are fused together by the application of heat (or they may be heated first and then crimped). The spacer lines or cords project the desired distance outside the grooves to correctly space the cathode active surfaces from the anodes and give a proper uniform gap. They also protect the platinum, platinum-iridium or other noble metal or noble metal oxide coatings on the titanium anodes from being damaged by scratching against the cathode surfaces when the anodes are being installed or removed, since the lines act as bearing surfaces and guides. They further serve to divide clearance spaces into individual vertically directed passages, thereby preferentially bringing electrolyte into those sections where the electrolysis might be proceeding at a more rapid rate, since it is those areas in which the gases generated serve to lift the hypochlorite solution most rapidly through the electrolytic spaces. The spacer lines or cords also prevent shorting out of the cell. It is important that the clearance spaces between anode and cathode are not below a certain minimum, e.g, 1/32 inch, and it is preferred that the clearence be below a maximum, e.g., ⅛ in. Usually, however, the range will be held to from 1/32 in. to 3/32 in., preferably from 1/32 in. to 1/16 in.

During electrolysis, a mixture of sodium hypochlorite, sodium hydroxide, chlorine, and hydrogen is produced in the electrolytic chambers (227 and 229 in FIGS. 3 and 5). The gases cause the solution to be lighter than a gas-free solution and, therefore, the gas-laden solution rises to the electrode head chamber (231 in FIG. 5) above the electrolysis region, from which the gases move into a head space (233 in FIG. 5), and from which they pass into the manifold (203) via outlets (209), such gases usually containing less than 0.5% of chlorine.

A feature of the invention is the easy assembly and disassembly of the electrode groups, without damage. Although this is largely due to use of spacer lines or cords (509 in FIG. 11), it is also attributable to the filter press type design, which facilitates easy disassembly by release of compressive force.

In operation, two modes of electrolyte circulation may be used. In series operation, spend electrolyte from one cell unit is passed into the feed header inlet orifice (207 in FIGS. 2 and 4) of the adjacent unit. It is preferred, however, to pass electrolyte through individual cell units in parallel, feeding brine from a supply source (not shown) into the feed header in that orifice (207) of all cell units comprising a cell assembly (101 in FIG. 1). All cell units discharge their product through electrolyte overflow headers (215 in FIGS. 2 and 4) and external pumping means can be used to recirculate electrolyte through the same or another cell. When operated in parallel fashion, the cell is charged with sodium chloride solution at the desired concentration (usually saturated), cooling water is circulated through coolant orifice (211) and out coolant collector header (213), if desired, and the current is turned on. In the diaphragmless space between the anode and the cathode, sodium hydroxide, chlorine and hydrogen are generated, and the sodium hydroxide and the chlorine react to produce sodium hypochlorite. The hydrogen and the aqueous sodium hypochlorite rise past the electrode to near the top of the cell, from which the hydrogen may be withdrawn, with the sodium hypochlorite solution, at first only dilute, being returned downwardly past the baffles (225 in FIG. 2) and between the electrode subassemblies to the bottom of the cell. After sufficient circulation of electrolyte past the electrode, the concentration of sodium chlorate produced from the hypochlorite is high enough to allow for withdrawal of some solution as product. A portion of the amount withdrawn is mixed with saturated sodium chloride solution or is resaturated by addition of NaCl crystals, acidified with HCl or chlorine or a mixture thereof, heated or cooled, as desired (usually cooling is effected), and is returned to the cell near the top or bottom thereof. The process is operated continuously in such manner. In other embodiments of the invention the sodium chloride and acid are added directly to the electrolyte cell and no chlorate removed from the cell is returned to it. Under preferred conditions or operation, the current density is maintained at 4 to 6 amperes per square inch but may be considerably higher, the voltage is about 3 to 5 volts and the gap between anodes and cathodes is from 1/32 to ⅛ inch. The concentration of sodium chloride in the aqueous electrolyte solution removed from the cell is from about 100 to 150 grams per liter and the concentrations of sodium chlorate is from about 300 to 520 grams per liter. The pH of the electrolyte during electrolysis will be maintained at about 6 to 6.5 by the additive of hydrochloric acid or chlorine to the returning electrolyte so that the electrolyte returned has a pH of from about 4 to 5. Current efficiencies obtained are about 95%. Seals are made of Viton A, silicone rubber, neoprene, or other suitable plastic, with neoprene preferable. They are made to close tolerances and hence give good seals in the described applications without too great a distortion of the desirably accurately fitted anode parts. The temperature of the electrolyte will be maintained at less than 105° C, preferably being about 20° to about 95° C, and more preferably being about 70° to about 80° C. Electrolyte temperatures may be controlled by recirculation of portions thereof, by regulation of portions of feed for the various zones and by changing the temperatures of feeds. Refrigeration and other cooling means may also be employed utilizing coolant fluids entering at temperatures below the ambient temperature.

The following example illustrates the operation of the present apparatus in, but does not limit, the invention. In particular, the following example pertains to the manufacture of sodium chlorate, but it is contemplated to use the present invention for making other metal halates. In the examples all parts are by weight and all temperatures are in degrees Celsius unless otherwise indicated.

EXAMPLE 1

A frame of the type illustrated in FIGS. 2 and 4 is injection molded. The mold is so constructed that passageways, bosses, channels, ledges, ribs, manifolds, alignment and tightening means are molded to the frame produced. Where feasible, threaded or partly threaded openings are also molded so as to be available for and receptive to threaded orifices or other parts of the cell frame. The frames are molded of a mixture of 25% calcium silicate fiber, 10 EP rubber impact modifier, 37.5% Exxon D-561 propylene-acrylic acid polymer, and 27.5% Shell 7525 polypropylene copolymer, and the products made are examined and tested. When tested in representative aqueous electrolyte suitable for use in an electrolytic cell for the production of sodium chlorate from sodium chloride solution, the frame shows no significant weakening, possibly because there are no incipient cracks or points at which the calcium silicate is exposed. Also, when tested for dimensional stability at temperatures over the range of 40° to 95° C, which temperatures can be used in normal electrolysis in this type of cell, the frames are stable and do not warp, crack, check, craze or otherwise distort.

The frames thus made are assembled into cells, using neoprene gaskets for sealing. The anode employed is a solid titanium plate and the cathode is a plate of steel. The intercell connector is of solid titanium construction, and the threaded stud welded into the intercell connector is of titanium-clad copper. The anode current distributor is of titanium, and the cathode busbar current distributor is of red brass. The anode bolt is of solid titanium.

The frames and cell walls are about 1.1 meter × 1.1 meter and the cells are about 11 centimeters thick. The cell walls and other plastic parts thereof in the cell, such as the bosses, walls defining the header and passageways, and ledges and channels are from 1 to 3 centimeters thick.

Between the cathode and the anode is a series of vertical polytetrafluoroethylene (Teflon®) flexible separating spacers or lines, each 2.5 millimeters in diameter, which are employed as vertical spacers every 15 centimeters along the anode-cathode gap, and together with a gasket, which is of a thickness such as to produce about a 2.5 millimeter gap between the cathode and the anode, these maintain the anode and cathode at a uniform distance from each other.

In the assembly of the cell 35 frames are assembled. Each frame is positioned on a temporary aligning means or bar. The cathode assembly is positioned in a fitting relationship with the cathode side of the cell frame, and the threaded stud welded to the intercell connector is passed through the sealing gasket and cell frame and threaded into the cathode bolt hole. The anode assembly is then bolted to the intercell connector. Next, the Teflon spacer cords are located between adjacent cell units, the gaskets are inserted, and the cell units are drawn neatly together in a filter press type arrangement so as to prevent fluid leakages. FIG. 1 shows a view of the assembled cell stack or bank. Connections are then made to sources of feeds and electricity and to discharge piping.

A brine solution containing 310 grams per liter of NaCl is introduced into the cell as a startup feed and subsequently is used as makeup feed. The inlet temperature of the brine is about ambient, from 15° to 30° C, but it is soon heated up to cell operating temperature, which is such that the liquor drawn off from the cell is at about 70° C. Chlorine gas is fed in with the makeup brine or with the recirculated electrolyte to acidify the liquor entering the electrolytic zone. Acidification is carried out to the extent that the takeoff liquor has a pH of 6.1.

After circulation of electrolyte has begun and the cell is started in operation the cell voltage is controlled so as to be at about 3.3 to 3.6 volts, preferably about 3.4 volts, with a current density of 4 amperes per square inch. When the circulating electrolyte shows an increase to a content of sodium chlorate of 420 grams per liter, liquor is taken off from that circulating and is made up with feed brine. Takeoff and makeup are continuous. Analysis of the liquor shows 135 grams per liter of NaCl, 420 grams per liter of $NaClO_3$ and 2.4 grams per liter NaOCl. Gas removed from the cell contains 1.6% chlorine and 3.0% oxygen but it is considered that chlorine content can be reduced to less than 0.5% under best operations. Generally, the gas will contain less than 2.0% of chlorine.

Operation of the cell is continued and feed takeoffs are regulated so as to maintain the electrolytic equilibrium and permit takeoff of the cell liquor at the analysis indicated. Under such operating conditions it is found that the cell efficiency is about 95% or better. The various components of the cell withstand the operating conditions and the chemicals with which they come into contact so well that repairs and replacements are not necessitated for periods of over a year. However, after about 6 months of operation under the conditions described, the cell stack is opened and the electrodes, frame, gaskets and fastening means are inspected. The electrodes are sill operative and the frame shows no signs of significant weakening or distortion, despite the fact that during the normal operation of the cells, including some shutdowns, the temperatures varies over the range of about 25° to 95° C.

In variations of this experiment, the filled polypropylene resin employed in one made from a resin mix of 30% of the described sodium silicate fiber, 10% E P rubber impact modifier, 45% Exxon D-561 propyleneacrylic acid copolymer mix, and 15% of Shell 7525 polypropylene copolymer. The results obtained are almost as good as those of the formulation previously given except that it is noted that the frames are somewhat more susceptible to cracking under extreme conditions. In a further variation, there is employed 20% of asbestos and 80% of polypropylene homopolymer. Although this frame is a useful one, it is not as good as that initially described. However, an improvement on it, made and tested the same way as described above, is one in which the resin mix is of 20% asbestos, 10% mica, 40% of homopolymer and 30% of copolymer.

Operations at the other conditions described in the foregoing specification and operations at the conditions of the this example modified as indicated in the specification, result in the efficient production of sodium and other metal chlorates.

EXAMPLE 2

The procedure of Example 1 is repeated, utilizing 30% calcium silicate fibers 10% E P rubber impact modifier, 45% Exxon D-561 propyleneacrylic acid copolymer resin, and 15% Shell 7525 polypropylene copolymer formula, but lowering the cathode-anode distance to 2 millimeters. In modifications of the cells the ruthenium oxide on titanium anode is changed so as to be active on all surfaces thereof. Under such conditions efficient electrolysis is effected without damage to the framing material. Teflon® spacers 1.5 millimeters in diameter are used to separate the anodes and cathodes.

EXAMPLE 3

Frames are made by the methods described in Example 1, from 45% of polypropylene homopolymer, 35% of polypropylene copolymer and the remainder (no impact modifiers present) of mica flakes (200 mesh), calcium silicate fibers (wollastonite), calcium silicate fibers (synthetic) talc or asbestors (chrysotile). Unmodified homopolymer, copolymer and 50:50 homopolymer-copolymer mixtures are also used. Frames are molded of each of these. When tested by practical use tests, in the electrolytes under electrolyzing conditions, it is found that the use of the calcium silicate fibers in a homopolymer-copolymer mix is best, and that the filled polymers are superior in physical properties, especially dimensional stability and neat resistance, to the unfilled materials. However, while the differences are important, it is possible to use all of the filled polypropylene frames in commercial application, and the unfilled frames, while inferior, are still operative. Frames made of other polymers, such as polyvinyl chloride, polytetrafluoroethylene and polyethylene, while not normally commercially acceptable for long term use, are operative for short term use in electrolytic cells and are advantageous when they have molded into them by ordinary injection molding techniques, when applicable, the various headers, passageways, orifices, alignments, mounting and fastening means of the apparatus as of this invention.

EXAMPLE 4

The procedures of Example 1 are repeated, but the electrodes are varied in size and inter-electrode distances given therein are varied. In such cases, electrolysis results and the frames are sufficiently stable to be commercially acceptable. No significant problems are encounted in the operation of these cells utilizing injection-molded frames. Furthermore, with the pre-molded bosses, ledges, channels, etc. in the frames, assembly of parts is facilitated and is accomplished in shorter periods of time, decreasing the expense of cell assembly. Accordingly, the present cells represent an important advance in the electrolytic methods for the manufacture of halates.

EXAMPLE 5

The procedure of Example 1 is repeated, but the frame is injection molded using a thermoplastic phenylene oxide-based resin formulated from a process for oxidative coupling of phenolic monomers, and containing 25% calcium silicate fiber as a filler. Testing as described in Example 1 shows a cell frame without significant weakening in sodium chloride solution, and with dimensional stability over a range of 40° to 95° C, without warping, cracking, checking, crazing, or other distortion. Neoprene gaskets are used for sealing the frames into a cell, and solid titanium intercell connectors are used. The frames and cell walls are about 1.1 meter × 1.1 meter in size, and the cells are about 11 centimeters thick. Teflon® flexible separating spacers 2.5 millimeters in diameter are employed as vertical spacers every 15 centimeters along the anode-cathode gap. When the cell is operated according to conditions described in Example 1, efficient production of sodium chlorate results.

EXAMPLE 6

The procedure of Example 5 is repeated but the frame is an unreinforced thermoplastic phenylene oxide-based resin formulated from a process for oxidative coupling of phenolic monomers. The frame is vacuum molded in two parts, which are then fused together by heat. When tested and operated according to conditions described in Example 5, satisfactory results and efficient production of sodium chlorate are obtained.

The invention has been described with respect to illustrations and specific working examples thereof but is not to be limited to these because it is evident that one of ordinary skil in the art with the present specification before him will be able to utilize substitutes and equivalents without departing from the spirit of the invention or going outside its scope.

I claim:

1. A diaphragmless electrolysis cell for the manufacture of metal halates comprising in combination a plurality of electrode units, each electrode unit having a single frame member, an anode and cathode mounted to opposing sides of the frame member in spaced relationship with each other, means for maintaining each electrode unit uniformly spaced from adjacent electrode units, means for holding the electrode units together to effect a series cell arrangement, means for electrically connecting the electrode units, inlet means for feeding electrolyte to the cell, and outlet means for removing cell liquor and gaseous material from the cell.

2. The electrolysis cell of claim 1 wherein the frame member includes means for circulating coolant fluid.

3. The electrolysis cell of claim 2 wherein means for circulating the coolant fluid comprises a multiplicity of channels in the frame member.

4. The electrolysis cell of claim 1 wherein the frame member includes means for retaining cell liquor during conversion to metal halate.

5. The electrolysis cell of claim 4 wherein means for retaining the cell liquor comprises baffles located on the frame member.

6. The electrolysis cell of claim 1 wherein the anode and cathode are electrically interconnected through the frame member.

7. The electrolysis cell of claim 1 wherein the frame member is fabricated with a resinous molding compositions containing a material selected from polymers of propylene or phenylene oxide.

8. The electrolysis cell of claim 7 wherein the frame member is polypropylene filled with a filler selected from the group consisting of asbestos, mica, calcium silicate, talc and mixtures thereof.

9. The electrolysis cell of claim 8 wherein the filler is calcium silicate.

10. The electrolysis cell of claim 1 wherein the cathode is iron or mild steel.

11. The electrolysis cell of claim 1 wherein the anode is dimensionally stable comprising an active surface of a noble metal or a noble metal oxide over a valve metal base.

12. The electrolysis cell of claim 11 wherein the active surface of the anode is a material selected from the group consisting of platinum, platinum-iridium alloy and ruthenium oxide over a valve metal selected from the group consisting of titanium, tantalum and niobium.

13. The electrolysis cell of claim 11 wherein the axis of the anodes and cathodes of the electrode unit and the electrical connections thereof extend horizontally.

14. The electrolysis cell of claim 1 wherein the frame members are injection molded.

15. The electrolysis cell of claim 1 wherein the frame members are vacuum formed.

16. The electrolysis cell of claim 1 where the frame members are formed in two or more sections, and fused together.

17. The electrolysis cell of claim 16 wherein the frame members are fused together by heat.

18. An electrode unit for a diaphragmless electrolysis cell for the manufacture of metal halates comprising in combination a single polymeric frame member for housing electrodes, an anode and a cathode mounted to opposing sides of the frame member in spaced relationship with each other forming chambers on both sides of the frame member, the frame member being further equipped with means for circulating coolant and retaining cell liquor for conversion to chlorate, inlet means for electrolyte feed, and outlet means for removing cell liquor and gaseous material.

19. The electrode unit of claim 18 wherein the means for circulating the coolant and retaining cell liquor comprises a plurality of channels and baffles molded into the frame member.

20. The electrode unit of claim 19 wherein the anode is dimensionally stable comprising an active surface of a noble metal or a noble metal oxide over a valve metal base.

* * * * *